US006076322A

United States Patent [19]

D'Andrea et al.

[11] Patent Number: 6,076,322

[45] Date of Patent: Jun. 20, 2000

[54] WALL STUD ASSEMBLY FOR USE IN FORMING PREFABRICATED PARTITIONS OR WALLS

[76] Inventors: Anthony F. D'Andrea; Manfred Mantay, both of 340 W. 78 Rd., Hialeah, Fla. 33014

[21] Appl. No.: 09/008,922

[22] Filed: Jan. 20, 1998

[51] Int. Cl.[7] ..... E04B 1/38; E04C 2/52

[52] U.S. Cl. ..... 52/481.1; 52/220.2; 52/220.7; 52/282.4; 52/282.5; 52/285.2; 52/464; 52/468; 52/481.2; 52/771

[58] Field of Search ..... 52/220.2, 220.7, 52/282.4, 282.5, 285.2, 464, 468, 481.2, 771, 582.1, 481.1, 584.1

[56] References Cited

U.S. PATENT DOCUMENTS

| | | | |
|---|---|---|---|
| 2,363,164 | 11/1944 | Waller . | |
| 3,128,852 | 4/1964 | Chell et al. . | |
| 3,267,631 | 8/1966 | Hammitt . | |
| 3,300,919 | 1/1967 | Hiller | 52/481.2 |
| 3,339,324 | 9/1967 | Stackhouse | 52/464 |
| 3,477,752 | 11/1969 | Richter | 52/464 |
| 4,034,957 | 7/1977 | Cody . | |
| 4,427,230 | 1/1984 | Avny | 296/43 |
| 4,433,514 | 2/1984 | Henges, Jr. et al. . | |
| 4,557,089 | 12/1985 | Breithaupt | 52/235 |
| 4,775,570 | 10/1988 | Ohlenforst et al. . | |
| 4,850,167 | 7/1989 | Beard et al. | 52/200 |
| 4,891,920 | 1/1990 | Pingston | 52/145 |
| 4,896,473 | 1/1990 | Liebetrau | 52/748.11 |
| 4,910,938 | 3/1990 | McGee . | |
| 4,991,368 | 2/1991 | Amstutz . | |
| 5,163,257 | 11/1992 | Crowell . | |
| 5,287,675 | 2/1994 | McGee . | |
| 5,485,704 | 1/1996 | Sandor, Sr. . | |

*Primary Examiner*—Carl D. Friedman
*Assistant Examiner*—Jennifer I. Thissell
*Attorney, Agent, or Firm*—Malloy & Malloy, P.A.

[57] ABSTRACT

An improved wall stud assembly used to form a prefabricated partition or wall assembled within the interior space of a warehouse, factory or other building structure, the assembly comprising a first elongate stud member and a second elongate stud member, each having a joining part and a panel receiving flange disposed along each longitudinal side of the joining part. Preferably each of the joining parts of the stud members include a plurality of punched holes and extruded holes formed therein and relatively oriented to allow interconnecting fasteners to be applied to the stud member from either side of the stud assembly. In the assembled orientation, the stud members are arranged so that the joining parts thereof are disposed in substantially confronting relation to one another and with the plurality of punched holes on the first stud member generally aligned with the extruded holes of the second stud member, with a pair of prefabricated partitions or wall panels, each being received by corresponding panel receiving flanges of the first and second stud members, and at least one fastener element extending initially through a punched hole on the first stud member and subsequently into one of the extruded holes on the second stud member.

16 Claims, 5 Drawing Sheets

WALL STUD ASSEMBLY FOR USE IN FORMING PREFABRICATED PARTITIONS OR WALLS

BACKGROUND OF THE INVENTION

1. Field of Invention

The present invention relates to the structural joining together of prefabricated walls and panels to provide temporary partitions within the interior space of a building. More particularly, the present invention relates to an improved wall stud assembly for connecting prefabricated partitions or wall panels which significantly reduces the time and expense associated with the manufacture, assembly and installation of conventional wall stud assemblies. In addition, the present invention is also structured to function as a conduit within the prefabricated partition or wall constructed, for receiving and concealing utility lines such as electrical wires, telephone and computer/data lines and the like therein.

2. Description of the Related Art

In many buildings and industrial settings, it is often necessary to quickly form temporary and/or removable office spaces, storage rooms, administrative cubicles, and the like. Due to the flexibility offered by prefabricated walls, they are becoming increasingly popular in current times, and are even beginning to be utilized for more permanent partitioning of space.

In general, prefabricated partition walls are constructed by utilizing a plurality of wall stud assemblies, each one of which is used to commonly secure two prefabricated partitions or wall panels together in order to form an integrated, prefabricated partition or wall. As shown in FIG. 1, labelled "Prior Art," each wall stud assembly 1, customarily comprises two generally duplicate stud members, 2, 4. Each stud member is seen to comprise a first panel receiving part 6, 6', a joining part, 7, 7', and another panel receiving part, 8, 8'. As shown, the joining parts 7, 7' of the stud member are joined to each other, typically by way of a bolt 9 extending therethrough, to produce two oppositely facing channels. A prefabricated partition or wall panel 5, often including an insulating layer, is received in each of the stud member's panel receiving parts, 6, 6', and 8, 8' respectively, and is positioned relative thereto in order to form a prefabricated wall. As mentioned above, in order to secure the joining parts 7, 7' of the stud members together, a bolt 9 is typically passed through a first one of the stud members and extends through and into the other stud member. It is known to form the stud members 2, 4, with holes punched therein so as to readily permit a bolt to be passed therethrough. In general, a nut is then matingly secured to the exposed distal end (not shown) of the bolt 9 so that the stud members 2, 4, of the prefabricated partition or wall are securely maintained in position.

There arise, however, many situations in which it is difficult or impossible to secure a nut to the exposed distal end of the bolt after it passes through stud member 4 forming a prefabricated wall partition. For example, it is not uncommon for a prefabricated wall to be positioned closely adjacent to an external, load bearing wall or other structural wall within the building where the prefabricated partition is located. In such instances, there is often inadequate space for a worker to position himself or herself in proximity to the stud member through which the distal end of the bolt passes, and it may thus be impossible to secure a nut to the bolt end. In other instances, for example, where a prefabricated wall forms the exterior wall of an elevated area such as a balcony or atrium, it is very difficult and even unsafe to secure a nut to the bolt passing through the stud member of the prefabricated wall. In such situations, it may be necessary to provide a ladder so that a worker can reach the bolt and manually secure a nut thereto. There can be instances, however, when even that is not feasible. For example, where a balcony is formed of prefabricated wall partitions to extend several stories into the air within a building's interior, it may require that a movable scaffolding structure be assembled and moved into place so as to permit the stud members to be properly joined together. Doing so, however, substantially increases the time and labor costs involved with assembling prefabricated partition walls, not to mention the risk of injury to a worker, all of which are undesirable.

One effort to solve some of the above described problems associated with properly joining together the stud members which make up a prefabricated wall or partition, involved forming a riv-nut assembly on the joining part 7', of the stud members so as to avoid the step of manually installing a nut on the distal end of the bolt extending therethrough. Riv-nut assemblies, are designed to permit a worker to join together the stud members of the prefabricated wall partition by simply inserting a bolt through the punched hole of the first stud member and securing the distal end into the riv-nut mounted on the second stud member. Given the design of the riv-nut assembly, when the distal end of the bolt passes therein, there is no need for a nut to be secured to the bolt. Thus, an advantage of the riv-nut assembly is that a bolt or other like fastener, once passed through the first stud member, can be automatically secured to the riv-nut by a single worker positioned on only one side of the prefabricated partition wall.

Unfortunately, however, in order to produce a stud member with riv-nut assemblies positioned thereon, a tedious, labor-intensive, and time consuming process must be followed, which naturally, adds significant costs to the manufacture of the stud members and to the overall cost of utilizing a prefabricated partition or wall. More specifically, attaching a plurality of riv-nuts at proper locations on a stud member first involves forming a plurality of holes on the stud member by manually punching each hole utilizing a punch press. Once the series of holes are punched, a single riv-nut is manually placed in each hole. Next, a riveter device presses down on each of the manually positioned riv-nuts, thereby expanding the base thereof in order to affix it to a stud member. Subsequently, in order to ensure that the riv-nut does not become inadvertently removed from the stud member, a serrated washer is manually placed on the shaft of the riv-nut. This laborious process, as well as the extra material costs makes producing a stud member with several riv-nut assemblies positioned thereon more expensive to form and install and therefore, uneconomical for many applications. Consequently, to minimize the added cost associated with forming stud members with riv-nut assemblies, it is common to provide only one of the pair of stud members with riv-nut assemblies, while the other stud member is provided with a series of only punched holes. Naturally, due to the time and expense involved, it is not feasible to form riv-nut assemblies on each of the two stud members which make up a wall stud assembly. There are several drawbacks to this cost saving effort wherein two different types of stud members are utilized. First, it becomes extremely crucial to estimate and order the precise number of stud members needed for a particular project. That is, because this cost saving system utilizes two different types of stud members, which must be utilized concurrently, it is imperative that the number of stud members having punched holes thereon are equal to the number of stud members having riv-nut assemblies formed thereon as a shortage of either type of stud members will make it impossible to complete or at least will delay the completion of the prefabricated partition walls. Second, the use of two distinct types of stud members creates added and unnecessary administrative costs by complicating inventory as well as the ordering, packaging, shipping, and installation of the stud members. Given these unnecessary impediments, it will generally be more economical to utilize the common system of using a fastener and a nut to secure the stud members together instead of stud members having riv-nut assemblies thereon, particularly where a worker is likely to have access to both sides of a prefabricated partition or wall.

Accordingly, there remains a significant need in the art for an improved wall stud assembly which permits workers to assemble and join together the stud members used to form a prefabricated partition or wall, without having to manually secure a nut or like fastener catching mechanism to the distal exposed end of a bolt or other fastener which passes through the stud members. Any such improved wall stud assembly should be able to avoid the drawbacks encountered with other systems in the art which have required the costly affixation of riv-nut assemblies to one or more stud members. Any such improved wall stud assembly should further provide a practical and inexpensive alternative by simplifying inventory, ordering, packaging, accounting, shipping, and installation of same.

SUMMARY OF THE INVENTION

The present invention is designed to solve the remaining needs in the art and relates to an improved wall stud assembly for connecting prefabricated partitions or wall panels. The improved wall stud assembly of the present invention comprises a first and a second elongate stud member, each of which includes a joining part and a longitudinally extending panel receiving flange on opposite ends of the joining part. The joining part of at least the first elongate stud member has a plurality of punched holes formed therein for permitting a bolt or other fastener element to be easily passed therethrough. Preferably, the plurality of punched holes are formed on and disposed generally along a longitudinal axis preferably spaced laterally from a longitudinal center line of the joining part of at least the first elongate stud member. As a unique feature of the present invention, the joining part of at least the second elongate stud member has a plurality of extruded holes formed therein which are specifically configured to permit the distal end zone of the bolt or fastener element to be passed therethrough and to interconnect therewith so as to securely join together the stud members, without the need for a nut to be attached to the distal end of the bolt, so as to form the wall stud assembly of the prefabricated partition wall. Preferably, the plurality of extruded holes are formed on and disposed generally along a longitudinal axis which preferably is also laterally spaced from the longitudinal center of the joining part of at least the second elongate stud member. Ideally, the joining parts of both the first and second elongate stud members have a plurality of both punched holes and extruded holes formed therein, with the punched holes extending along one longitudinal axis thereof and the extruded holes extending along a generally parallel, longitudinal axis thereof closely adjacent the other. The linear arrays of both the plurality of punched holes and plurality of extruded holes are each preferably spaced outwardly from a longitudinal center line of the joining part and on opposite sides thereof. Also, each one of the extruded holes is further preferably disposed on the joining parts so as to be closely adjacent to one of the punched holes and laterally aligned therewith in a generally similar horizontal plane when the stud member is vertically oriented.

In one preferred embodiment of the present invention, the joining parts of each stud member includes a first and a second linear array of alternating punched holes and extruded holes, wherein each linear array extends along a different longitudinal axis spaced laterally outward from a longitudinal center line of the joining parts on opposite sides thereof and in parallel relation to one another and to the longitudinal center line. Further, the holes of each linear array are disposed such that each punched hole of each linear array is laterally aligned with an extruded hole of the other linear array. Also, a feature of this embodiment is that the plurality of bolts or like fasteners serving to interconnect the two joining parts of the stud members of a stud assembly may be introduced from either side of the stud assembly by first passing each bolt through the punched holes of the joining part of one stud member and then into coupling engagement with an aligned extruded hole of the substantially confronting joining part of the other stud member. Since all of the interconnecting bolts will normally be applied from only one side of the stud assembly, the bolts will be arranged in an alternating, vertically spaced or "zigzag" pattern. This preferred disposition or pattern of the interconnecting bolts will provide even clamping pressure on the gripped wall panels and assure a better hold thereon as well as eliminating the possibility of gaps between the wall panels and the stud assemblies.

In the assembled orientation, the first and second elongate stud members are disposed preferably in a generally vertical attitude, with the joining parts disposed in a generally confronting but possibly spaced apart distance from one another so as to permit a prefabricated partition or wall panel to be snugly received in corresponding pairs of longitudinally extending panel receiving flanges on the joining parts. Further, the first and second stud members are preferably arranged to form the prefabricated partition or wall with the plurality of punched holes formed on the joining part of the first stud member generally aligned with the plurality of extruded holes formed on the joining part of the second stud member regardless of the embodiment of the subject invention utilized. Thus, the present invention readily accepts a plurality of fastener elements, such as bolts or screws, each of which first passes through one of the punched holes on one of the stud members and extends through an aligned extruded hole on the other stud member, whereby, the first and second stud members are thereby secured together to help form the wall stud assembly, without the need for applying any type of nut or other fastener catching mechanism to the distal exposed end of the bolt passing through the joining part of the second stud member.

Another feature of the present invention is the provision of an elongated cover plate formed in overlying, covering relation to the joining part of either or both stud members comprising the stud assembly. The subject cover plate extends along the length of the stud member to which it is attached and covers the exterior, exposed surface of the joining part thereof so as to hide any holes and/or bolts formed in or connected to the joining parts. Each cover plate is cooperatively dimensioned and configured so as to define a passage between the cover plate and the joining part of the stud member which it serves to cover. Utility lines such as electrical wires, telephone and computer data lines and the like, can be enclosed within and passed along the length of such passages, thereby preventing the utility lines from being viewed or from possibly harmful exposure to personnel.

A primary object of the present invention is to provide an improved wall stud assembly which permits and facilitates the installation of a bolt or other fastener through the joining parts of a pair of stud members so as to securely join them together, without requiring the installation of a nut or other catching mechanism on the exposed distal end of the bolt which passes through the second of the two stud members.

It is also an object of the present invention to provide an improved wall stud assembly having a cover plate which overlies a joining part of at least one stud member defining the subject stud assembly so as to form a conduit or passage therebetween, wherein the conduit or passage is designed to safely receive and conceal utility lines including electrical wires, telephone and data lines, alarm lines, etc.

A further object of the present invention is to provide an improved wall stud assembly for use in forming a prefabricated partition or wall assembly which is readily and inexpensively manufactured, and further, which is easy to assemble and to securely join together.

Yet another object of the present invention is to provide an improved wall stud assembly which utilizes pairs of stud members that are generally identical so that any stud member can be secured to any other stud member by attaching interconnecting bolts thereto from either side of the coupled stud members.

An advantage of the present invention is that it significantly reduces the time and expense typically associated with the manufacture, assembly and installation of conventional wall stud assemblies used with prefabricated partitions or wall panels.

Yet another advantage of the present invention is the providing of an improved stud assembly which applies substantially even clamping pressure on the wall panels defining the prefabricated wall structure and in addition, assures a better gripping hold to be exerted thereon while eliminating the possibility of gaps existing between the improved stud assembly and the wall panels.

A further advantage of the present invention is that because each of the stud members are virtually identical, such that any stud member can be readily interchanged with another stud member, the inventory for, ordering, storage, packing, shipping, and installation of the stud members is greatly simplified compared to conventional wall stud assemblies.

These and other objects, features, and advantages of the present invention will become more readily apparent from the attached drawings and the detailed description of the preferred embodiments, which follow.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 2:
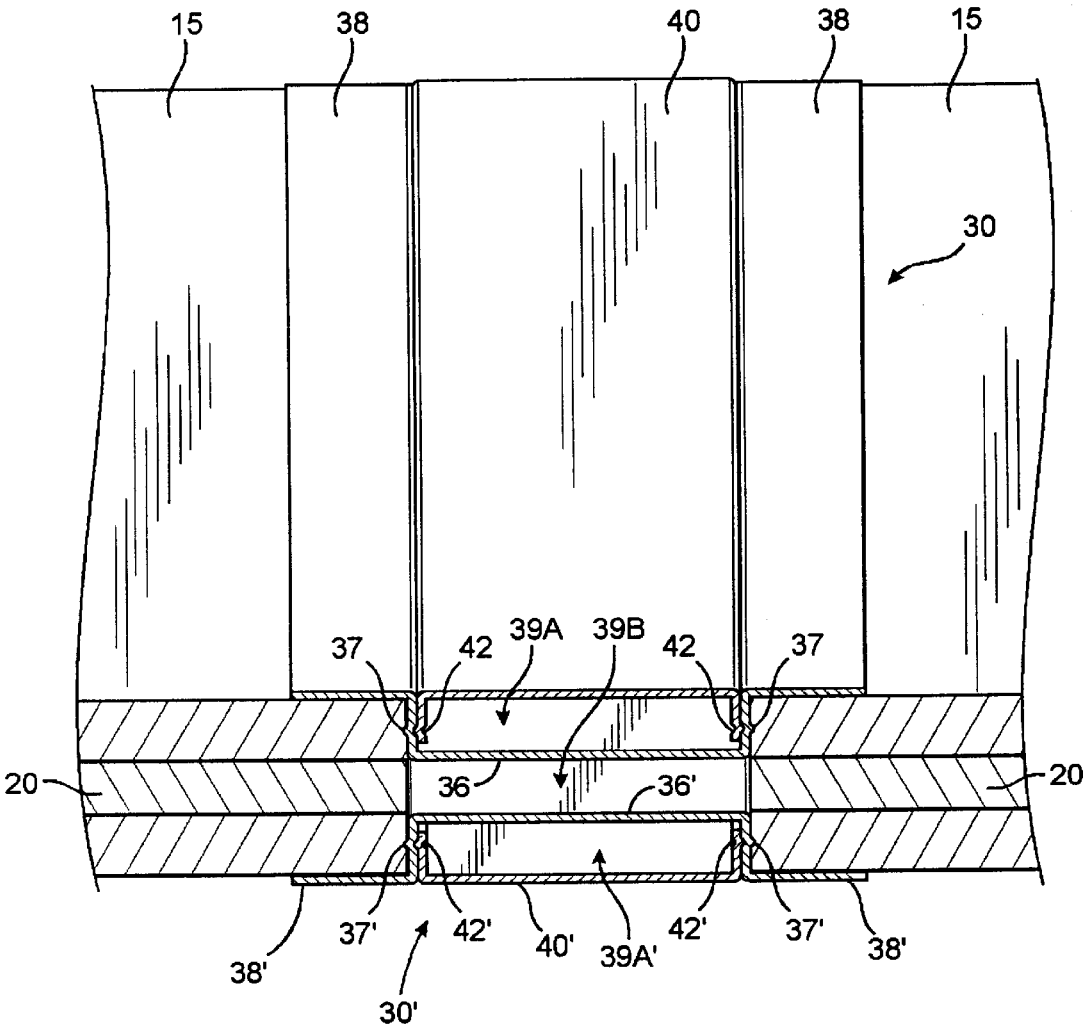
FIG. 2 is a partial perspective view of the improved wall stud assembly of the present invention illustrating an assembled orientation with partition wall panels received thereby.

Shown throughout FIGS. 2–5, the present invention is directed towards an improved wall stud assembly 10 for connecting prefabricated partitions and/or wall panels. As best illustrated in FIG. 2, the improved wall stud assembly 10 of the present invention includes a first elongate stud member 30 and a second elongate stud member 30'. Preferably, each stud member 30, 30' respectively includes a joining part 36 and 36' and a pair of longitudinally extending, panel receiving flanges 38 and 38' disposed at opposite ends of the joining part 36, 36'. Preferably, each stud member 30, 30' is formed of a thin sheet of metallic material, such as steel or aluminum. Of course, other materials such as metallic alloys and even fiberglass or plastic may be utilized to form the stud members 30, 30' without departing from the spirit and scope of the present invention.

Still referring to FIG. 2, in the assembled orientation, the first and second elongate stud members 30, 30' are preferably disposed in a generally vertical manner, with the joining parts disposed in generally confronting relation and yet a spaced apart distance from one another. From FIG. 2, it will be seen that in the assembled orientation, each one of the pair of longitudinally extending, panel receiving flanges 38, on one of the stud members, such as 30, are disposed generally near to one of the pair of longitudinally extending, panel receiving flanges 38' on the other stud member, such as 30', thereby defining a channel which readily permits a prefabricated partition or wall panel 15 to be snugly received therein. If desired, the prefabricated partition or wall panel 15 may be secured to the stud members 30, 30' by fastening means such as screws, nails, nuts, bolts, adhesive material, and the like. Preferably, however, the prefabricated partition or wall panel 15 is not secured to the stud members 30, 30', but instead, is structured to fit snugly within the channel formed thereby.

The joining part 36, 36' of at least one of the elongate stud members 30, 30', and preferably, the first elongate stud member 30, includes a plurality of punched holes 32, formed therein, each of which is preferably disposed generally along a longitudinal axis thereof. The punched holes 32, 32' are preferably formed in a manner that leaves the edge of the holes substantially smooth and flat so that there are no sheared edges which protrude outwardly from an exposed surface of the stud member 30, 30'. The punched holes 32, 32' may be formed by utilizing a wide variety of known and relatively inexpensive manufacturing techniques. For example, the punched holes 32, 32' may be formed after the stud members 30, 30' are constructed by simply utilizing a standard drill with a drill bit structured for boring through metal. Alternatively, the punched holes 32, 32' may be formed simultaneously with the manufacture of the stud members 30, 30' by forming them as part of the same mold. Of course, punched holes 32 32' can also be inexpensively formed by utilizing any of a wide variety of drill press mechanisms to cut out the holes 32, 32' while the stud members 30, 30' are being pressed or rolled.

Figure 3:
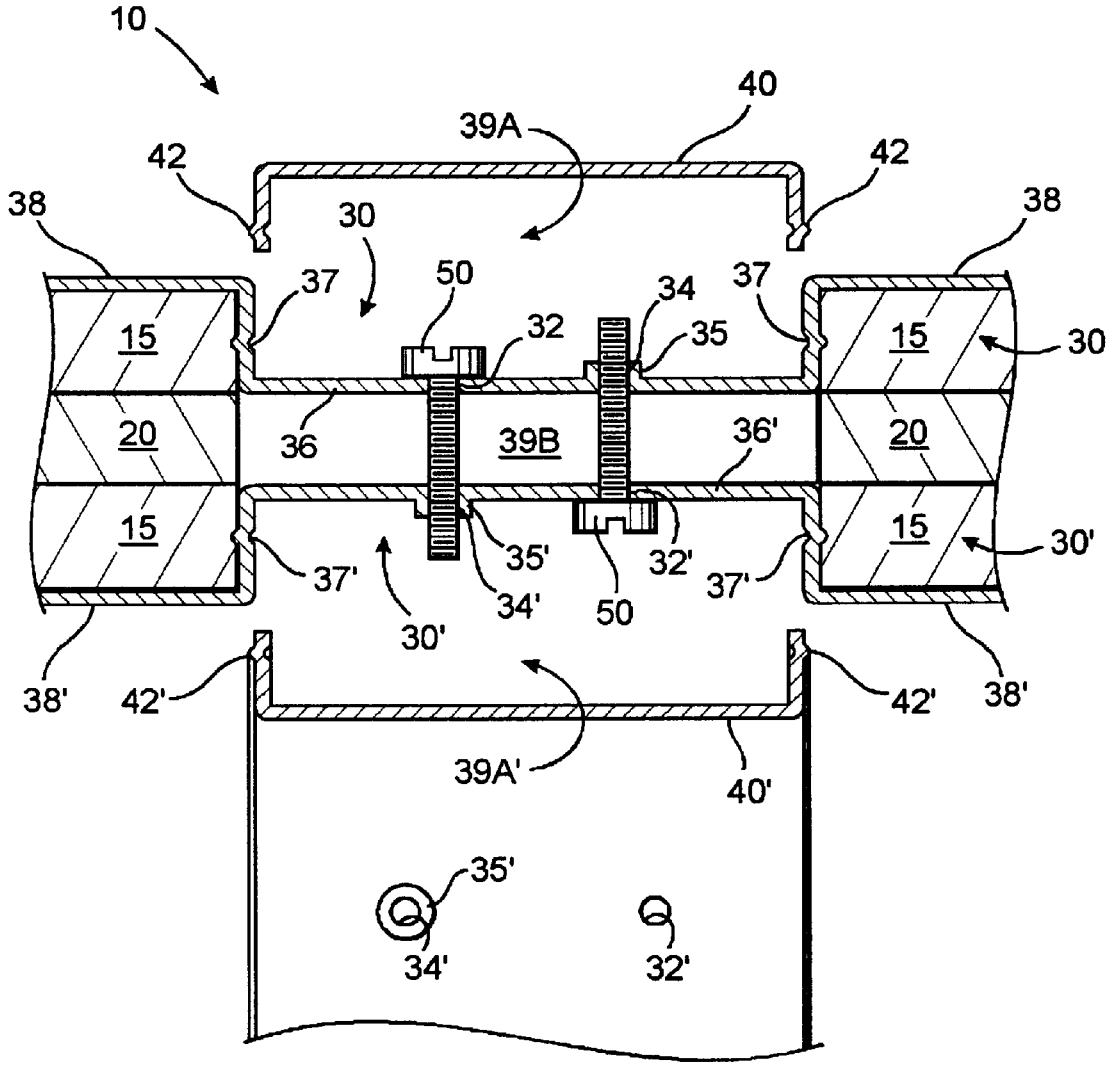
FIG. 3 is a cross-sectional view of the improved wall stud assembly of the present invention in the preferred embodiment, illustrating a top view of both a punched hole and an extruded hole on each joining part of the stud members.
Figure 4:
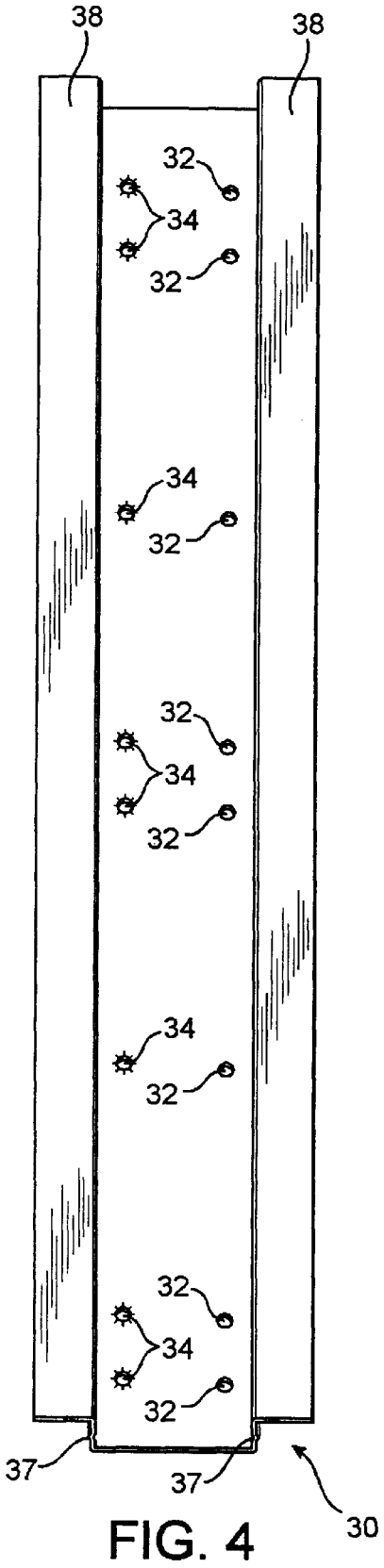
FIG. 4 is a top perspective view illustrating one stud member of the present invention in the preferred embodiment and in an unassembled orientation.

As has been described, the improved wall stud assembly 10 includes a second elongate stud member 30' of which a unique feature is to provide at least the joining part 36' thereof with a plurality of extruded holes 34'. In the preferred embodiment, the plurality of extruded holes 34' are disposed generally along a longitudinal axis preferably spaced laterally outward from a longitudinal center line of the second elongate stud member 30' and preferably in substantially aligned relation with the punched holes 32 of the first stud member 30 when the stud members 30 and 30' are confronting one another as in FIGS. 2 and 3. Thus, in the assembled orientation of one embodiment, the two sets of holes, namely, the punched holes 32 of the first elongate stud member 30 and the extruded holes 34' of the second elongate stud member 30' will be generally aligned in relation to one another so as to accommodate a bolt or other fastener element 50 being passed initially through one of the punched holes 32 or 32' on one stud member, either 30 or 30', and subsequently through an aligned one of the extruded holes 34 or 34' on the other stud member. The extruded holes 34, 34' can be formed on the stud members 30, 30' in a wide variety of ways although they will preferably be formed by forcefully thrusting a point, dowel, or other protruding device through the sheet of metallic material used to form the stud members 30, 30', thus causing shear failure of the metallic sheet metal similar to that observed when a projectile, such as a bullet, is shot through sheet metal. As such, in one preferred embodiment, a feature of the extruded holes 34, 34' is that they have a rough sheared edge which protrudes out from an exposed surface of the joining part of the stud member 30 and 30' as best shown in FIGS. 3 and 4. In the preferred embodiment, each of the extruded holes 34, 34' include a distally disposed lip member 35, 35' that projects outwardly from the stud member 30, 30'. The purpose of either the sheared edges or of the lip member 35, 35' of the extruded holes 34, 34' is to define a configuration which will serve to attach to the distal end of the bolt 50 or other type fastener passing therethrough.

In a more preferred embodiment, however, the second elongate stud member 30' is also formed to include a plurality of punched holes 32' formed therein, each of which is preferably disposed generally along another longitudinal axis thereof. Further, the first elongate stud member 30 is structured to include a plurality of extruded holes 34 formed therein, each of which is also preferably disposed generally along another longitudinal axis thereof. In this more preferred embodiment, each of the elongate stud members 30, 30' have the plurality of punched 32, 32' and extruded holes 34, 34' disposed along a different longitudinal axis each of which is spaced laterally outward from a longitudinal center line thereof and in generally parallel relation to each other and to the center line. Preferably, each one of the extruded holes 34, 34' is disposed on the joining part 36, 36' so as to be closely adjacent to one of the punched holes 32, 32' and substantially laterally aligned therewith, as best illustrated in FIG. 4.

As best shown in FIG. 3, in the assembled orientation, the first elongate stud member 30 will preferably be arranged in relation to the second elongate stud member 30' so that the punched holes 32 on the joining part 36 of the first stud member 30 are preferably disposed to align generally with the extruded holes 34' of the joining part 36' of the second stud member 30'. Similarly, the extruded holes 34 on the joining part of the first stud member 30 are preferably disposed to align generally with the punched holes 32' of the second stud member 30'. In this preferred orientation, a bolt or other fastener element 50 can initially be passed through one of the punched holes 32 on the first elongate stud member 30 and subsequently through a corresponding one of the extruded holes 34' on the second stud members 30'. The extruded holes 34, 34', and in particular, the sheared edges and/or the lip member 35, 35' thereof are structured and disposed to engage the distal end of the bolt or fastener element 50 therein. Thus, there is no need for a catching mechanism, such as a nut, to be coupled to the exposed distal end of the fastener 50. In the preferred embodiment, the fasteners 50 are bolts, although it will be appreciated that screw type fasteners or other known fasteners may also be utilized without departing from the scope and spirit of the present invention. Of course, in constructing a wall stud assembly according to the present invention, several bolts and/or fastener elements 50 will most likely be utilized, each of which can be passed through one of the punched holes 32 on the first elongate stud member 30 and to extend into one of the corresponding extruded holes 34' of the second elongate stud members 30'.

Figure 5:
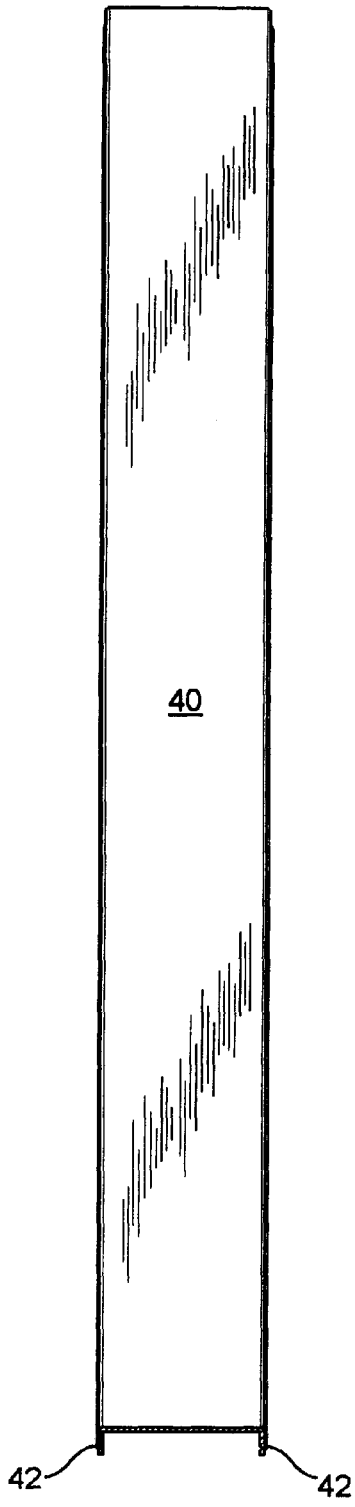
FIG. 5 is a top perspective view illustrating a preferred cover plate for the present invention, namely, one which is capable of being removably secured to and over the joining part of one of the stud members.
Figure 6:
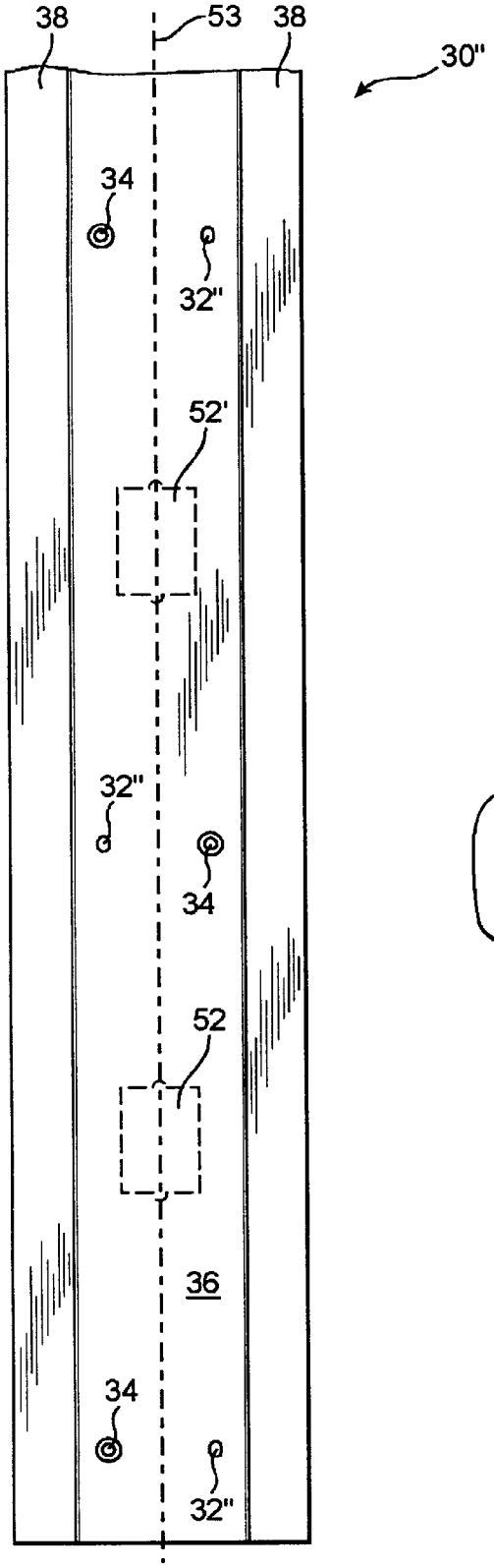
FIG. 6 is a front plan view of another embodiment of a stud member of the subject invention.
Figure 7:
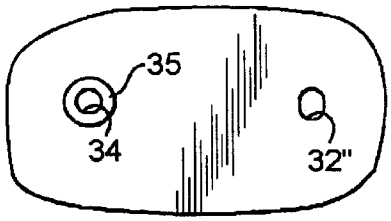
FIG. 7 is a detailed view showing the configuration of both an extruded hole and a punched hole formed on the embodiment of FIG. 6.

Another preferred embodiment of the present invention is shown in FIGS. 6 and 7 wherein each of the stud members forming a stud assembly are represented in FIG. 6 as 30". Stud member 30" includes the joining part 36 integrally connected to the two longitudinally extending and outwardly disposed flanges 38. This embodiment differs from the embodiments of FIGS. 1–5 in that the joining part 36 includes two linear arrays of holes extending along different longitudinal axes located in outwardly spaced relation on different sides of an imaginary center line 53. However, an important feature of this embodiment is the formation of alternating punched and extruded holes in each linear array. As will be noted in FIG. 6, each linear array includes each punched hole 32" disposed in alternating relation with vertically spaced extruded holes 34.

The result of this alternating "punched-extruded" hole array will be that the bolts 50 (See FIG. 3) or any like connector, may be introduced to the interconnected stud members of a given stud assembly from either side of the stud assembly. The attachment of each of the bolts 50 would be accomplished by first passing the bolt through the punched hole 32" and then subsequently through and in attaching, engaging relation with an aligned extruded hole 34 formed in the other, confronting stud member of a given stud assembly. The resulting pattern of interconnecting bolts would be in a somewhat alternating, vertically spaced "zigzag" pattern since, as a practical matter, all the bolts 50 would be applied from the same side of the formed stud assembly. Further with regard to FIG. 3, it is shown, utilizing the embodiment discussed therein, that the bolts 50 are capable of being mounted from either or both of the sides of the stud assembly and are accordingly oppositely positioned. However, as a practical matter and particularly when utilizing the embodiment of FIG. 6, all of the bolts will preferably be disposed in their interconnecting relation to confronting stud members from the same side, thereby forming the aforementioned "zigzag" pattern of the attaching bolts. Therefore, when using the embodiment of FIG. 6, the bolts of FIG. 3 will be oriented in the same direction rather than in opposite directions as actually shown.

With regard to FIG. 7, the specific configurations of the punched holes 32" would preferably be in somewhat of an elongated or oblong configuration rather than completely circular as is the hole 32' of FIG. 3. The extruded hole 34 would have an outwardly protruding lip portion or segment as at 35 extending outwardly from an outermost surface of the joining part 36 in which it is formed. It is important to emphasize that the configuration of the extruded hole 34 including the dimension and configuration of the protruding lip portion 35 is such as to facilitate direct attachment to the distal end of the bolts 50 or like fastener attached thereto. This would eliminate the necessity of any type of riv-nut, or like fastener previously utilized in the prior art. Further with regard to the embodiment of FIG. 6, a plurality of knock-out plates 52 are formed in spaced relation to one another along the length of stud member 30". Each of these knock-out plates can be easily removed by a worker in order to add a junction box for electrical connections or to provide access to any of the utility lines which may pass along the length of the formed stud assembly. An uppermost knock-out plate 52 can be utilized to direct a conduit to the ceiling area by way of conduit elbow which is well-known in the prior art.

Figure 1:
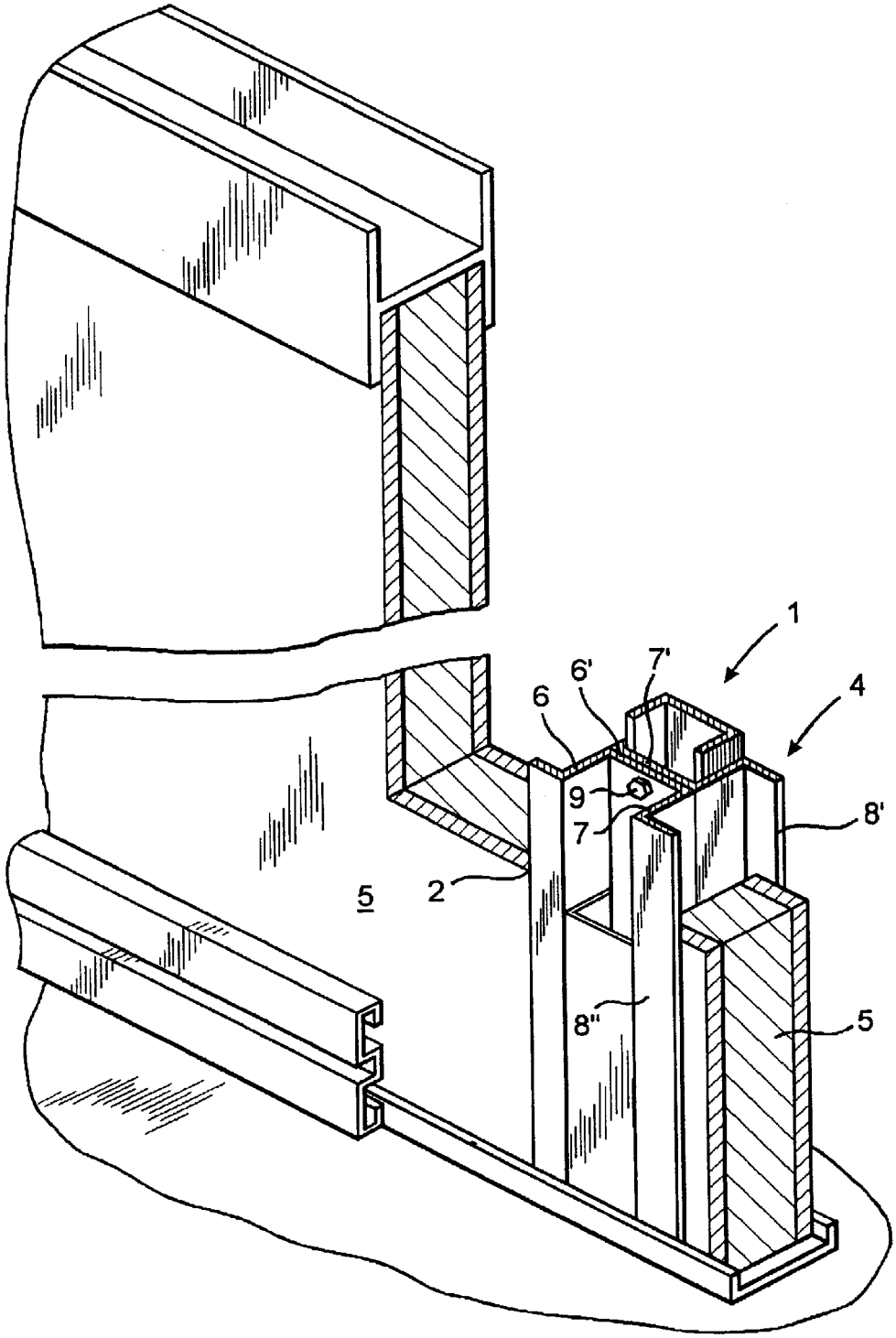
FIG. 1 PRIOR ART
FIG. 1 is a perspective view of one commonly known type of wall stud assembly used in the art to form a prefabricated partition or wall.

Once a wall stud assembly 10 according to any of the embodiments of the present invention has been securely assembled, it is ready to receive the prefabricated partitions and/or wall panels, such as by inserting one partition or wall panel 15 within corresponding pairs of the longitudinally extending flanges 38, 38' on each side of the wall stud assembly 10, as shown in FIGS. 2 and 3. Thus, in assembled form, the improved wall stud assembly 10 of the present invention preferably receives prefabricated partitions or wall panels 15 that face or generally oppose the wall stud assembly, as shown in the figures. Additionally, in order to offer enhanced insulated and/or noise containment features, the partition and/or wall panel 15 may include an insulation layer 20, as shown in FIGS. 1 and 3.

In order to conceal the joining parts 36, 36' of the elongate stud members 30 and 30', and the holes and/or bolts or other fasteners 50 connected thereto, the improved wall stud assembly of the present invention preferably includes at least one cover plate 40, seen in FIG. 5, and preferably a cover plate 40, 40' for each stud member 30, 30', respectively. The cover plates 40, 40' are preferably structured and disposed to provide a neat and aesthetically pleasing appearance to the improved wall stud assembly 10 and the prefabricated partition or wall assembly which it forms. In this regard, the cover plates 40, 40', elongate stud members 30, 30' and prefabricated partitions and/or wall panels 15 may be color coordinated. In the preferred embodiment, the cover plates 40, 40' are structured to be removably connected respectively to one of the elongate stud members 30, 30' and to span across the joining part 36, 36' thereof. To accomplish this, and with reference to FIGS. 4 and 5 the cover plate 40 is representative of both cover plates 40 and 40' and preferably has a generally "U" shaped configuration and is sized to be snugly received by and between the longitudinally extending flanges 38 of the stud member 30. Additionally, the stud member 30 preferably includes a groove 37 formed on an inner facing surface of each longitudinally extending flange 38 as shown in the figures. In order to facilitate removable securement of the cover plate 40 to a stud member 30, the cover plate 40 also preferably includes a bead 42 which is preferably disposed at least partially, if not completely along each longitudinal edge, as shown in FIGS. 4 and 5. The bead 42 disposed on the cover plate 40 is structured so that it snugly fits within the groove 37 of the stud member 30 and prevents the cover plate 40 from accidentally falling out of place or slipping. In an alternative embodiment, it will be understood that the groove 37 may be disposed on the cover plate 40 while the bead 42 is positioned on the first and second stud member 30. In another alternative embodiment, each of the cover plates 40, 40' may be secured by a plurality of snap-fitting pegs and holes disposed respectively on the cover plates 40, 40' and on the stud members 30, 30'.

In addition, the improved wall stud assembly 10 of the present invention is also structured to function as a conduit, within the prefabricated partition or wall assembly for receiving and concealing a variety of different types of utility lines, such as electrical wires, data and telephone lines, alarm lines and the like therein. Specifically, and in a preferred embodiment show in FIGS. 2 and 3, when the respective cover plates 40, 40' are assembled so as to fit in place on a stud member 30, 30', they are disposed a spaced distance from the joining part 36, 36' thereof and thereby form an interior chambers 39A, 39A' therebetween. The resulting interior chambers 39A, 39A' are structured and disposed for safely receiving the aforementioned utility lines or the like therein. These utility lines can then be longitudinally run up and/or down the stud members 30, 30', for interconnection with an electrical source, telephone equipment, computer facilities, etc. In addition, a conduit can be formed within the assembled stud assembly 10 itself, in that joining parts may be disposed in spaced apart, confronting relation to each other and an interior compartment 39B is defined therebetween. This interior compartment 39B may also provide a conduit within the prefabricated partition or wall assembly constructed, so as to safely receive the aforementioned type of utility lines therein. Accordingly, the present invention is also seen to provide a conduit assembly which can be utilized for safely passing utility lines through the prefabricated wall in a manner that conceals them from view and eliminates the possibility of inadvertent contact or exposure to these lines.

Since many modifications, variations, and changes in detail can be made to the described preferred embodiments of the invention, it is intended that all matters in the foregoing description and shown in the accompanying drawings be interpreted as illustrative and not in a limiting sense. For example, the present invention could readily be utilized in other than a vertical orientation and/or to form other portions of prefabricated wall partition, such as a corner. As another example, the present invention could be utilized as part of portable or prefabricated building structures, such as, but not limited to guard houses, food service buildings, parking lot booths, control rooms and the like. Thus, the scope of the invention should be determined by the appended claims and their legal equivalents.

Now that the invention has been described,

What is claimed is:

1. An improved wall stud assembly for connecting prefabricated partitions or walls, comprising:

a) a first elongate stud member and a second elongate stud member, each having a joining part and a longitudinally extending panel receiving flange disposed on opposite sides of said joining part and extending along a length thereof;

b) said joining part of at least said first elongate stud member having a plurality of punched holes formed therein and disposed generally along a first longitudinal axis thereof, c) said joining part of at least said second elongate stud member having a plurality of extruded holes formed therein and disposed generally along a second longitudinal axis thereof, d) each of said extruded holes structured and configured for attachment with at least a distal end of a fastener element extending therethrough, e) said first and second stud members arranged in a generally vertical orientation and relatively disposed to accommodate a depth of the prefabricated partitions or walls to be received by corresponding ones of said longitudinally extending panel receiving flanges of said first and second elongate stud members, f) said joining parts of said first and second stud members disposed in substantially confronting relation to one another such that said plurality of punched holes of said first stud member are disposed in generally aligned relation with said extruded holes of said second stud member, and g) at least one fastener element structured to extend initially through one of said punched holes on one of said stud members and subsequently into one of said extruded holes on the other of said stud members so as to secure said first and second stud members together and form said wall stud assembly.

2. An improved wall stud assembly as recited in claim 1 wherein at least one of said stud members comprises a plurality of knock-out plates each fixedly and removably secured to said joining part thereof in longitudinally spaced relation to one another and in covering relation to a correspondingly disposed access opening integrally formed in said joining part of said one stud member.

3. An improved wall stud assembly as recited in claim 1 further comprising:

a cover plate secured to at least one of said stud members between said longitudinally extending panel receiving flanges and in covering relation to said joining part of said one stud member.

4. An improved wall stud assembly as recited in claim 3 wherein said cover plate is secured to one of said stud members a spaced apart distance from said joining part so as to form an interior chamber therebetween, said interior chamber being structured and disposed to enclose at least one utility line therein.

5. An improved wall stud assembly as recited in claim 4 wherein said cover plate is structured to be removably secured to said stud member.

6. An improved wall stud assembly as recited in claim 5 wherein said cover plate defines a generally "U" shaped cross-sectional configuration and a bead formed on opposite sides thereof, said bead disposed and structured to mate with a groove formed on each of said longitudinally extending panel receiving flanges of said stud member.

7. An improved wall stud assembly as recited in claim 3 wherein each of said stud members includes a cover plate secured thereto a spaced distance from said joining part thereof so as to form an interior chamber therebetween, said interior chamber being structured and disposed to enclose at least one utility line therein, each of said cover plates being structured and disposed to be removably secured to respective ones of said stud members and wherein each of said cover plates include a generally U-shaped cross-sectional configuration and further include a bead formed on opposite sides thereof, said bead disposed and structured to mate with a groove formed on each of said longitudinally extending panel receiving flanges of each of said stud members.

8. An improved wall stud assembly for forming a prefabricated partition wall assembly, comprising:

a) a first elongate stud member and a second elongate stud member, each stud member having a joining part extending along the length thereof and a panel receiving flange disposed along each of two opposite longitudinal sides of said joining part, b) said joining parts of said first and second elongate stud members each having a first linear array of holes and a second linear array of holes respectively extending along a first longitudinal axis and a second longitudinal axis, c) said first and said second longitudinal axis being disposed laterally outward and on opposite sides of a longitudinal center line of each joining part, d) said holes of each of said first and second linear arrays comprising longitudinally spaced apart, alternating punched holes and extruded holes, e) each extruded hole of each linear array being laterally aligned with a punched hole of the other linear array and each of said extruded holes of both linear arrays being structured and configured for attachment with at least a distal end of a fastener element extending therethrough, f) said first and second stud members arranged within the prefabricated partition wall assembly and being relatively disposed to accommodate a depth of the prefabricated partition wall assembly to be received by corresponding ones of said panel receiving flanges of said first and second elongate stud members, g) said first and second stud members further arranged so that joining parts thereof are disposed in substantially confronting relation to one another and with said plurality of punched holes of said first stud member generally aligned with said extruded holes of said second stud member, and h) a plurality of fasteners, each fastener disposed to extend initially through one of said punched holes on one of said stud members and subsequently into an aligned one of said extruded holes on the other of said stud members so as to secure said first and second stud members together and form said wall stud assembly.

9. An improved wall stud assembly as recited in claim 8 further comprising:

a first cover plate secured to said first stud member and a second cover plate secured to said second stud member.

10. An improved wall stud assembly as recited in claim 8 further comprising:

a cover plate secured to one of said stud members between said panel receiving flanges and in overlying substantially covering relation to said joining part thereof.

11. An improved wall stud assembly as recited in claim 10 wherein said cover plate is secured to one of said stud members a spaced apart distance from said joining part so as to form an interior chamber therebetween, said interior chamber being structured and disposed to enclose utility lines therein.

12. An improved wall stud assembly as recited in claim 11 wherein at least one said stud members comprises a plurality of knock-out plates each fixedly and removably secured to said joining part thereof in longitudinally spaced relation to one another and in covering relation to correspondingly disposed access openings integrally formed in said joining part of said one stud member.

13. An improved wall stud assembly as recited in claim 12 wherein each of said cover plates is removably secured to respective ones of said stud member by means of a bead and groove connection structured to removably snap said cover plates snugly into place on respective ones of said stud members.

14. An improved wall stud assembly as recited in claim 8 wherein said plurality of fasteners are collectively disposed in a zigzag pattern extending longitudinally along said first and second stud members.

15. An improved wall stud assembly for connecting panels of a prefabricated partition wall assembly, comprising:

a) a first elongate stud member and a second elongate stud member, each having a joining part and a panel receiving flange formed along each longitudinal side of said joining part, b) said joining parts of said first and second elongate stud members each having a plurality of punched holes formed therein and disposed generally along a first longitudinal axis thereof, c) said joining parts of said first and second elongate stud members each further having a plurality of extruded holes formed therein and disposed generally along a second longitudinal axis thereof, d) each of said extruded holes structured and configured for attachment with at least a distal end of a fastener element extending therethrough, and each of said extruded holes further disposed on said joining parts in laterally aligned and adjacent relation to one of said punched holes and in a substantially equivalent horizontal plane relative thereto, e) said first and second stud members arranged at a spaced apart distance and further arranged so that said joining parts thereof are disposed in substantially, confronting relation to one another and with said plurality of punched holes of said first stud member generally aligned with said extruded holes of said second stud member;

f) a pair of the panels of the prefabricated partition wall assembly, each being received by corresponding ones of said panel receiving flanges of said first and second elongate stud members, and g) at least one fastener element extending initially through one of said punched holes on said first stud member and subsequently into one of said extruded holes on said second stud member so as to secure said first and second stud members together and form said wall stud assembly.

16. An improved wall stud assembly as recited in claim 15 wherein at least one of said stud members comprises a plurality of knock-out plates each fixedly and removably secured to said joining part thereof in longitudinally spaced relation to one another and in covering relation to a correspondingly disposed axis opening integrally formed in said joining part of said one stud member.

* * * * *